US005492184A

United States Patent [19]

Jenne

[11] Patent Number: 5,492,184

[45] Date of Patent: Feb. 20, 1996

[54] EARTH BORING DEVICE

[75] Inventor: Dietmar Jenne, Strengelbach, Switzerland

[73] Assignee: Terra AG fuer Tiefbautechnik, Strengelbach, Switzerland

[21] Appl. No.: 198,898

[22] Filed: Feb. 18, 1994

[30] Foreign Application Priority Data

Feb. 22, 1993 [DE] Germany ..... 43 05 423.4

[51] Int. Cl.[6] ..... E21B 7/08

[52] U.S. Cl. ..... 175/73; 175/400

[58] Field of Search ..... 175/400, 73

[56] References Cited

U.S. PATENT DOCUMENTS

| | | | |
|---|---|---|---|
| 451,292 | 4/1891 | McKee | 175/400 |
| 2,196,940 | 4/1940 | Potts | 175/400 |
| 2,324,102 | 7/1943 | Miller et al. | 175/400 |
| 2,350,986 | 6/1944 | Collins | 175/400 |
| 2,686,660 | 8/1954 | Storm | 175/400 |
| 2,784,943 | 3/1957 | Bylund | 175/400 X |
| 2,903,239 | 9/1959 | Standridge | 175/400 |
| 3,431,991 | 3/1969 | Mikels | 175/400 |
| 4,930,586 | 6/1990 | Turin et al. | 175/25 |
| 4,953,638 | 9/1990 | Dunn | 175/400 |

FOREIGN PATENT DOCUMENTS

| | | | |
|---|---|---|---|
| 203743 | 10/1908 | Germany | 175/400 |
| 533681 | 9/1931 | Germany | 175/400 |
| 251322 | 8/1948 | Switzerland | 175/400 |

*Primary Examiner*—Hoang C. Dang

[57] ABSTRACT

In an earth boring device with a boring head (14) rotatable about its axis (16), which boring head for the control of its direction has a control surface (18) inclined to its axis (16) and at least one jet (20) for the discharge of a pressurized boring fluid, with the jet openings being arranged on a side of the boring head parallel to the axis of the boring head and facing away from the control surface (18), the axial spacing of the jets from the boring head tip and their stream direction are so chosen that in the use of the boring head the streams escaping from the jets reach essentially only the region of earth lying to the side of the boring head.

8 Claims, 1 Drawing Sheet

FIG. 1
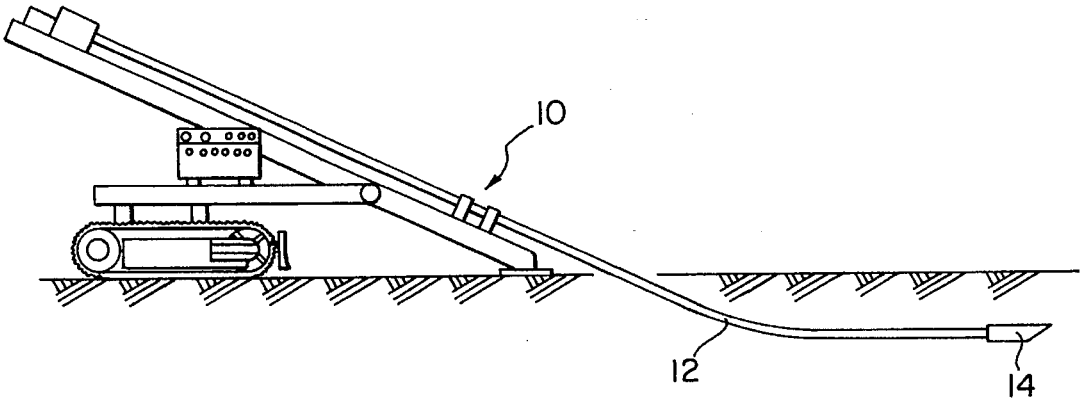
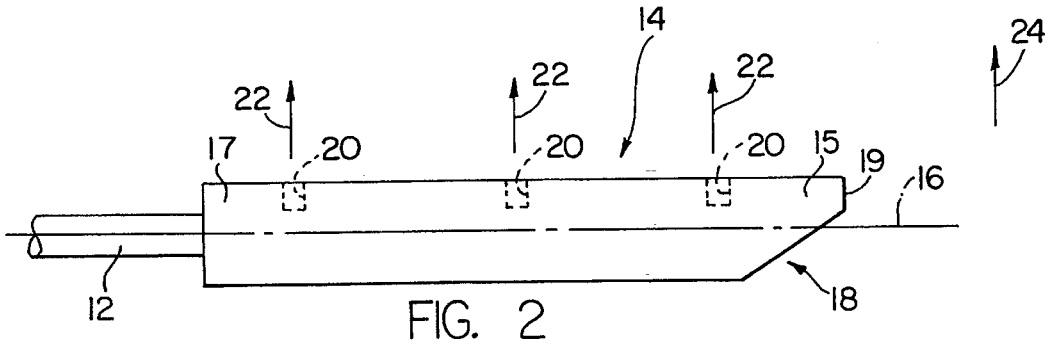
FIG. 2
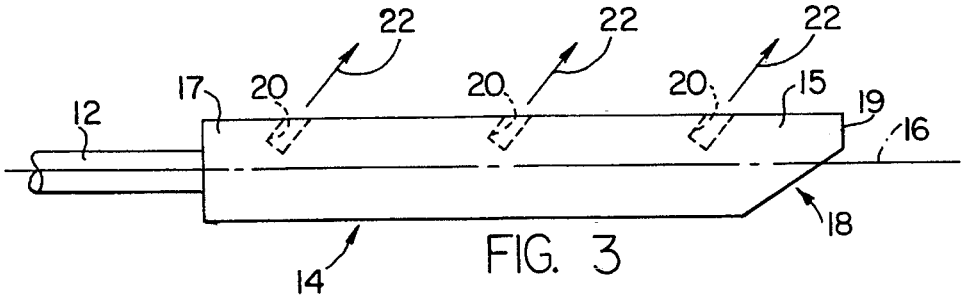
FIG. 3

EARTH BORING DEVICE

FIELD OF THE INVENTION

The invention concerns an earth boring device with a boring head rotatable about its axis, which boring head for the control of its direction has a control surface inclined to the axis of the head and on which head a jet is provided for the discharge of a boring fluid.

BACKGROUND OF THE INVENTION

A boring head of this type is known for example from U.S. Pat. No. 4,953,638. The boring head described there is fixed to a boring rod by means of which the boring head can be rotated and pressingly be driven forwardly. The boring head has an essentially wedge shape. On one of the wedge surfaces is fastened a boring blade, while a jet is arranged on the other wedge face, the stream direction of the jet being inclined at a small angle with respect to the forward drive direction, that is the boring head axis, so that the jet faces approximately in the forward direction.

During a straight running the boring head must be rotated. For a change in direction the boring head is brought to a position in which the boring blade carrying wedge surface faces oppositely to the desired deflection direction. Then the boring head is statically advanced by the boring rod. The boring head therefore moves in the desired deflection direction because of the flat side of the boring blade which serves as a control surface. The boring fluid flowing from the jet serves to support the boring effect, that is to cool the boring blade and to wash away the region of earth cut out by the boring blade.

With the rotation of the boring head the boring fluid loosens the earth lying in front of the boring head in a cone lying relatively closely around the boring axis. In this way the resistance of the earth in the forward drive direction is reduced while on the other hand the earth located around the boring head remains firm. Therefore it is difficult to actually deflect the boring head in the desired direction with a pregiven radius corresponding to the inclination of the control surface. Moreover the danger exists that the jets will plug up if the boring takes place for only a short time without boring fluid.

SUMMARY OF THE INVENTION

The invention has as its object to so form the boring head of a boring apparatus of the previously mentioned type that it can be deflected precisely and on a relatively small radius.

This object is solved in accordance with the invention in that the jet is arranged on a side of the boring head, which side is parallel to the axis of the boring head and faces away from the control surface. More than one jet can also be provided. The jets can be directed essentially perpendicularly to the boring head axis or can also be inclined at a certain angle to the boring head axis in the forward direction.

By means of the arrangement of the jet or jets on the boring head in accordance with the invention, through the outflow of the boring fluid the earth is loosened not directly in front of the boring head but to the side of the boring head. Therefore the earth at the location where the control surface is to engage it during the deflection remains firm while the earth in the direction in which the boring head is to be deflected is loosened. In order to avoid that the earth is circularly loosened during the rotation of the boring head during a straight run, in the solution of the invention the delivery of the boring fluid to the jet or jets can be shut off during the straight run, without danger of the jets becoming plugged, since they are arranged in a side surface of the boring head directed parallel to the boring head axis.

The boring head of the invention can be used for a boring device with a static forward drive as well as for an earth boring device with a dynamic percussion forward drive.

BRIEF DESCRIPTIONS OF THE DRAWINGS

Further features and advantages of the invention will be apparent from the following description, which in combination with the accompanying drawings explain the invention by way of exemplary embodiments. The drawings are:

FIG. 1—a schematic representation of an earth boring device,

FIG. 2—a schematic side view of a boring head according to according to a first embodiment of the invention, and FIG. 3—a representation corresponding to that of FIG. 2 but showing a boring head in accordance with a second embodiment of the invention.

DETAILED DESCRIPTION OF THE PREFERRED EMBODIMENTS

FIG. 1 shows a boring device embodying the invention which in a way known in itself includes a forward drive unit 10 and a boring rod 12, on the forward end of which rod is arranged a boring head 14. The forward drive unit 10 is made in the customary way and serves to rotate and statically drive the boring rod 12 forwardly as well as to deliver the boring fluid through the boring rod 12 to the boring head 14. The forward drive unit 10 can for example be constructed in the way described in U.S. Pat. No. 4,953,638 or can include a correspondingly made boring vehicle which is self moveable by means of a rubber caterpillar drive mechanism.

The boring head 14 has a generally cylindrical shape and includes a front portion 15 and a rear portion 17. The front portion 15 has a tip 19, forming the forward extremity of the head 14, and a control surface 18 at its forward end arranged at an incline to the longitudinal axis 16 of the head and extending rearwardly from the tip 19. One or more jets 20 are carried by the rear portion of the head and are arranged on the side of the head opposite to the control surface 18, which side is parallel to the axis 16, and through which jets a boring fluid from a non-illustrated conductor can flow under pressure. The jets are so arranged and formed that the stream direction of the jets, indicated by the arrows 22, is arranged generally perpendicularly to the axis 16. In the embodiment illustrated in FIG. 3 the jets 22 are so made and arranged that the stream direction indicated by the arrow 22 is inclined at an angle of less than 90 degrees to the axis 16 in the forward direction. The jets can be arranged in a row parallel to the axis with equal or unequal spacing over the length of the boring head. It is essential that the spacing of the jets from the boring head tip and the stream direction of the jets be so chosen that essentially the earth to the side of the boring head and not the earth lying directly in front of the boring head tip is softened or washed away.

During straight running the boring head 14 is rotated so that the boring head behaves like a rotationally symmetrically made boring head. During the straight running therefore no boring fluid need be injected into the earth through the jets 20. A delivery of boring fluid can, however, be practical in order to increase the slidability of the boring head.

If the forward drive direction is to be changed, for example in the direction of the arrow 24 of FIG. 2, the boring head is brought to the illustrated position in which the control surface 18 faces toward the side opposite to the arrow 24. In this position boring fluid is pumped through the jets 20 into the neighboring region of earth and that earth region is in this way loosened. Subsequently by static advancement of the boring head 14 the boring head is deflected toward the direction of the arrow 24 during which process boring fluid is also practically further ejected from the jets.

As can be recognized, the portion of the earth engaged by the control surface 18 remains dry and firm. In contrast to this the earth located to the side of the boring head in the deflection direction is loosened so that the boring head can easily move toward this direction. Thereby small deflection radii can be achieved, so that one obtains a relatively sensitive control.

Since the jets are formed on the side wall of the boring head which runs essentially parallel to the axis 16, no danger exists that the jets will become plugged during forward drive without the discharge of boring fluid. At least, upon the forward drive of the boring head the earth is not directly driven into the jet openings, so that the jet openings can easily be washed free.

The boring head can even without anything further be connected with a customary ram device without it slightly changing its function.

We claim:

1. An earth boring device for making substantially horizontal bores, said device comprising a boring head (14) rotatable about an axis (16) fixed relative to and extending longitudinally of said head, said boring head being elongated along said axis and having a front end and a rear end, said boring head at said front end having a tip and a control surface which control surface is arranged at an incline to said axis and extends rearwardly from said tip for control of the direction of said head, and said boring head having a cylindrical outer surface of substantially uniform diameter extending forwardly from said rear end of said head into intersection with said control surface and tip to define a point along said axis of rearmost extent of said control surface, and at least one jet (20) carried by said head for the discharge of a pressurized boring fluid from said head, the openings of said jets being arranged on a given side of said boring head (14) parallel to said axis (16) and facing away from said control surface (18), said jets being located rearwardly of said rearmost extent of said control surface and having stream directions inclined to said boring head axis (16) so that the streams flowing from the jets reach essentially only the region of earth lying next to said given side of the boring head.

2. An earth boring device according to claim 1, further characterized in that said stream directions of said jets (20) are essentially perpendicular to said boring head axis (16).

3. An earth boring device according to claim 1, further characterized in that said stream directions of said jets (20) are at an angle to said boring head axis (16) in the direction generally forwardly of said boring head (14).

4. An earth boring device according to claim 3, further characterized in that said stream directions of said jets (20) are essentially parallel to said control surface (18).

5. An earth boring device according to claim 1, further characterized in that a plurality of jets (20) are provided on said boring head.

6. An earth boring device according to claim 5, further characterized in that said jets are arranged in a row essentially parallel to said longitudinal axis of said boring head.

7. An earth boring device according to claim 1, further characterized in that it is made for a static forward drive of said boring head (14).

8. An earth boring device according to claim 1, further characterized in that it is made for a dynamic percussion ram drive of said boring head (14).

* * * * *